US008376163B2

(12) United States Patent
Smith et al.

(10) Patent No.: US 8,376,163 B2
(45) Date of Patent: Feb. 19, 2013

(54) LID AND CONTAINER FOR CARBONATED BEVERAGE

(75) Inventors: Matthew Eric Smith, Isle of Man (GB); Karl Mondszein, Mansfield (GB)

(73) Assignee: Carbonite Corporation, Panama City (PA)

( * ) Notice: Subject to any disclaimer, the term of this patent is extended or adjusted under 35 U.S.C. 154(b) by 812 days.

(21) Appl. No.: 12/447,414

(22) PCT Filed: Nov. 9, 2007

(86) PCT No.: PCT/GB2007/004289

§ 371 (c)(1), (2), (4) Date: Jun. 29, 2009

(87) PCT Pub. No.: WO2008/056164

PCT Pub. Date: May 15, 2008

(65) Prior Publication Data

US 2010/0072164 A1 Mar. 25, 2010

(30) Foreign Application Priority Data

Nov. 9, 2006 (GB) ..... 0622398.6

(51) Int. Cl.
*B65D 51/16* (2006.01)
*B65D 17/42* (2006.01)
*B65D 41/34* (2006.01)

(52) U.S. Cl. ..... 215/307; 220/780; 220/212; 220/277; 215/252; 215/228; 215/253; 215/317; 222/80

(58) Field of Classification Search ..... 215/228, 215/252, 253, 317, 307; 220/212, 277, 287, 220/780, 796, 367.1; 30/1.5, 417; 81/3.07, 81/3.09, 3.15, 3.48, 3.49; 222/80
See application file for complete search history.

(56) References Cited

U.S. PATENT DOCUMENTS 2,896,317 A * 7/1959 Vaive ..... 30/1.5
3,581,605 A * 6/1971 Taylor ..... 81/3.49

(Continued)

FOREIGN PATENT DOCUMENTS

WO 2005/092732 10/2005
WO 2006/114558 11/2006

OTHER PUBLICATIONS

PCT International Search Report for PCT/GB2007/004289 dated Jan. 31, 2008.

*Primary Examiner* — Anthony Stashick
*Assistant Examiner* — James N Smalley
(74) *Attorney, Agent, or Firm* — Harry K. Ahn; McCarter & English, LLP

(57) ABSTRACT

A beverage container comprises a bottle (2) and is sealed by a lid of resilient material. The bottle includes a neck (8) defining an opening and the lid includes a closure plate (32), integral with which is a depending skirt (18) extending around the outer surface of the neck. The skirt (18) carries an annular flange (20), which is in sealing engagement with the underside of the downwardly directed annular shoulder (14) on the outer surface of the neck. The annular flange (20) is connected to the skirt (18) by an integral hinge. The internal surface of the skirt (18) carries an annular protuberance (52), which is in sealing engagement with one side surface of the annular flange, the other side surface being in sealing engagement with the outer surface of the neck. The said one side surface of the annular flange includes an annular portion which extends downwardly and inwardly and is in contact with a corresponding annular portion on the surface of the annular protuberance (52).

7 Claims, 6 Drawing Sheets

U.S. PATENT DOCUMENTS 4,793,510 A * 12/1988 Arfert et al. ..... 220/793
5,058,755 A * 10/1991 Hayes ..... 215/252
5,103,990 A * 4/1992 Irwin ..... 215/320
5,740,612 A * 4/1998 Takeshita et al. ..... 30/115
6,119,883 A * 9/2000 Hock et al. ..... 215/252
D446,103 S * 8/2001 Olaneta ..... D8/98

* cited by examiner

LID AND CONTAINER FOR CARBONATED BEVERAGE

CROSS REFERENCE TO RELATED APPLICATIONS

This application is a national phase of PCT application No. PCT/GB2007/004289, filed Nov. 9, 2007, which claims priority to GB patent application No. 0622398.6, filed Nov. 9, 2006, all of which are incorporated herein by reference.

The present invention relates to containers for beverages, particularly carbonated beverages, and is concerned with that type of container which is described in International Patent Application No. WO 2005/092732. The invention is particularly, though not exclusively, concerned with such containers which have a wide mouth, that is to say with a diameter in excess of about 25 mm or more, preferably in excess of about 38 mm or 45 mm.

Beverage bottles typically have a narrow mouth with a diameter in the region of only 28 mm or less. Numerous ways of sealing the bottle top to the neck of the bottle are known but it will be appreciated that the problem of producing a seal on a container for a carbonated beverage increases exponentially as the diameter of the mouth increases because the area of the underside of the cap or top increases in accordance with the square of the radius. If the container cap or its seal should fail, the gas pressure will be released and the cap may even be projected explosively into the air with the resultant loss of the beverage and potential injury to bystanders. Similar sealing problems can arise also with uncarbonated beverages because if the container is subjected to an elevated temperature, e.g. it is exposed to direct sunlight, the gas pressure in the head space of the container will increase and if the container is inadequately sealed this will result in the leakage of gas to the atmosphere. This is not of itself inherently problematic, but when the container cools again, a subatmospheric pressure may be produced in the head space which results in the induction of atmospheric oxygen. This can result in oxidation of the container contents rendering them undrinkable.

The beverage container described in WO 2005/092732 will be described below with reference to FIGS. 1 to 5 of the accompanying diagrammatic drawings, in which.

Figure 1:
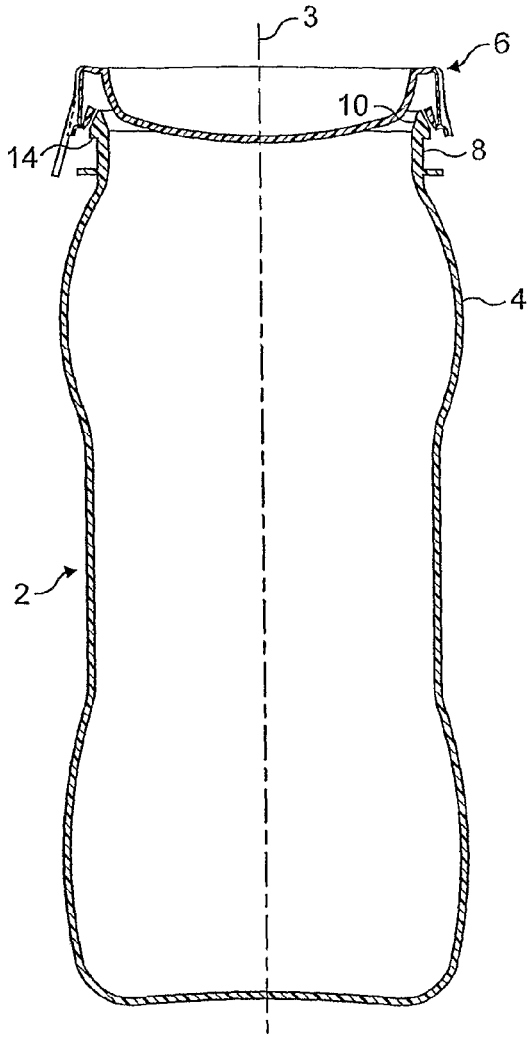
FIG. 1 is a vertical sectional view of a first embodiment of a beverage bottle with the lid in an intermediate position whilst being applied to the bottle.

As seen in FIG. 1, the bottle 2 is of generally cylindrical shape with an axis 3 and at least one portion 4 of increased size whose diameter is greater than that of the lid 6, for reasons which will be explained below. The bottle is in this case moulded from plastic material and it has a wide mouth, with a diameter of greater than 28 mm defined by the neck 8 of the bottle. The neck 8 terminates at a rim portion which is defined by an internal surface 10, which is inclined upwardly and outwardly with respect to the axis 3, and an external surface 12, which is inclined upwardly and inwardly with respect to the axis 3. The surfaces 10 and 12 thus converge and the external diameter of the bottle, specifically of its rim portion, thus initially increases from the top downwards. However, it then decreases abruptly at a downwardly directed annular shoulder 14 extending substantially perpendicular to the axis 3. The internal diameter of the rim portion, however, initially decreases from the top downwards.

Figure 2:
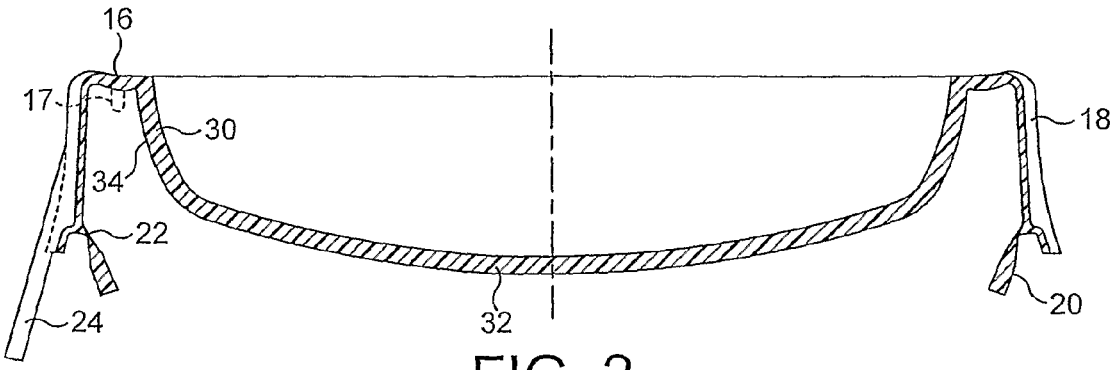
FIG. 2 is a vertical sectional view of the container lid before application to the bottle.

As best seen in FIG. 2, the lid comprises a one-piece component, preferably integrally moulded from resilient plastic material, such as polypropylene. It comprises a shaped closure plate, integral with which is a web 16 which extends, when the lid is connected to the bottle, over the rim of the bottle. Integral with the web 16 is a depending skirt 18, which extends downwardly around the exterior of the upper portion of the bottle. Integrally connected to the lower edge of the skirt 18 or to the inner surface of the skirt at a position adjacent its lower edge is an annular retaining flange 20. The flange 20 is elongate in axial sectional view and is connected to the skirt 18 by a resilient connecting web 22, which is of reduced thickness and thus constitutes an annular line of weakness or predetermined breaking point. Connected to the lid at one circumferential position is a rupturing tab 24 which extends downwardly below the lower edge of the skirt 18. This tab is connected to the skirt 18 at its side by two lines of weakness, i.e. regions of reduced thickness.

The closure plate of the lid is concave and thus extends into the neck of the bottle, when it is connected to the bottle. The closure plate comprises a wall portion 30 which extends generally downwardly and inwardly and merges at its lower edge with a base portion 32, which is downwardly arcuate, that is to say is of downwardly curved convex shape.

The lid is shown in FIG. 2 in the configuration in which it is moulded. In this configuration, the flange 20 extends downwardly and inwardly and the diameter of its lower edge is less than that of the upper edge of the rim of the bottle whilst the diameter of its upper edge is greater than that of the upper edge of the rim of the bottle.

Figure 3:
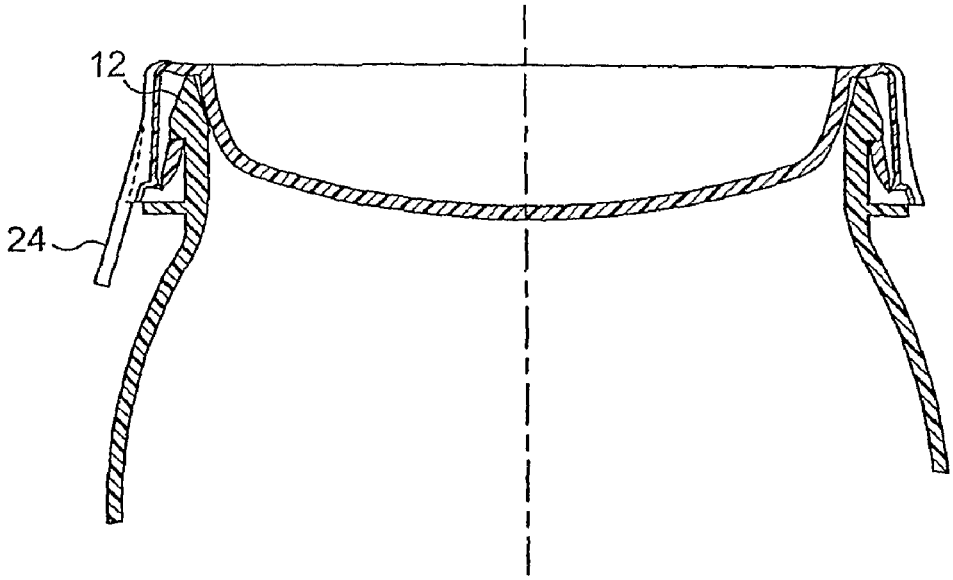
FIG. 3 is a scrap sectional view of the upper portion of the bottle showing the lid in the applied and sealed position.

The lid is fastened and sealed to the bottle by a simple snap-fit procedure. This is effected simply by lowering the lid into the rim of the bottle and then applying pressure. As the lid is lowered, the lower edge of the flange 20 comes into contact with the rim. This causes the flange to rotate inwardly about the web 22. As downward movement of the lid continues, the flange 20 moves downwardly in contact with the surface 12, as shown in FIG. 1, and the increasing diameter of this surface in the downward direction results in the rotation of the flange continuing, thus moving it ever closer to the inner surface of the skirt 18. The underside of the web 16 then contacts the upper surface of the rim of the bottle. However, the pressure on the cap is maintained and this results in slight deformation of the web 16. The cap and bottle are so dimensioned that the slight further downward movement of the cap caused by the deformation of the web 16, is sufficient to permit the free end of the flange 20 to move past the shoulder 14. It is then rotated in the opposition direction, i.e. inwardly, by the resilience of the web 22 and thus becomes locked behind the shoulder, as shown in FIG. 3. The lid is now retained in position on the bottle and cannot be removed without damaging or deforming it. The tension maintains the underside of the web 16 in engagement with the upper surface of the rim with a contact pressure sufficient to ensure that a first gas seal is formed along the annular line of contact. The tension in the skirt 18 also maintains the free end of the flange 20 in engagement with the surface of the shoulder 14 with a contact pressure sufficient to ensure that a second gas seal is formed along the annular line of contact. Furthermore, the resilience of the connecting web 22 forces the side surface of the free end of the flange 20 into contact with the side surface of the bottle and the contact pressure is preferably sufficient to form a third gas seal. The integrity of the first gas seal may be further enhanced, if required, by the provision of an annular bead or flange 17, which is shown in phantom lines only on the left-hand side in FIG. 2 and which will engage the side surface of the rim of the bottle and constitute an additional lip seal. This bead 17 is positioned and dimensioned so that it is deformed laterally by contact with the rim of the bottle and thus urged by its resilience into contact with the side surface of the rim and thus forms a further seal. If the pressure in the bottle should rise to a high value sufficient to deform the cap away from the rim of the bottle, thereby breaking the first gas seal, pressurised gas will flow into the space defined by the outer surface of the rim, the skirt 18 and the flange 20. This pressure will act on the flange 20 to press it yet more firmly against the side surface of the rim, thereby increasing the integrity of the third gas seal.

If yet further sealing integrity is required, yet a further gas seal may be provided, as in the illustrated embodiment, between the surface 10 of the rim and the opposed surface 34 of the wall portion 30. Thus in this embodiment, these two surfaces are formed as complementary sealing surfaces in sealing engagement with one another. If the pressure in the bottle should become super-atmospheric, either as a result of the liberation of carbon dioxide from a carbonated beverage or as a result of the expansion of gas in the head space of the bottle due to an increase in temperature, the centre of the concave base portion 32 will be deformed upwardly and this will inherently result in the outer edge of the base portion 32 and thus the lower edge of the wall portion 30 moving slightly outwards. This will result in an increase in the contact pressure between the sealing surfaces 10 and 34 and thus in an enhancement to the integrity of this further gas seal. The beverage therefore not only has both primary and secondary gas seals but also has a further gas seal. The integrity or sealing ability of this further seal increases as the gas pressure within the container increases.

When it is desired to open the bottle, the user merely grasps the lower edge of the rupture tab 24 and pulls it outwardly. The lines of weakness immediately rupture or stretch and the upper edge of the tab 24, which is connected to the web 16, rotates, thereby breaking the second and third gas seals. This rotation is transmitted to the web 16, which thus moves away from the rim of the bottle, thus breaking the first gas seal. This movement of the web 16 also causes the sealing surfaces 10 and 34 locally to move apart, thereby also breaking the further gas seal. The container is thus depressurised. The outward movement of the tab 24 initiates tearing of the thin connecting web 22, and once tearing has started it is a simple matter to keep it going by exerting upward and outward pressure on the tab 24 until the lid is completely disconnected from the flange 20, which remains in position around the neck of the bottle. The lid may now be discarded and the contents of the bottle dispensed or drunk.

Figure 4:
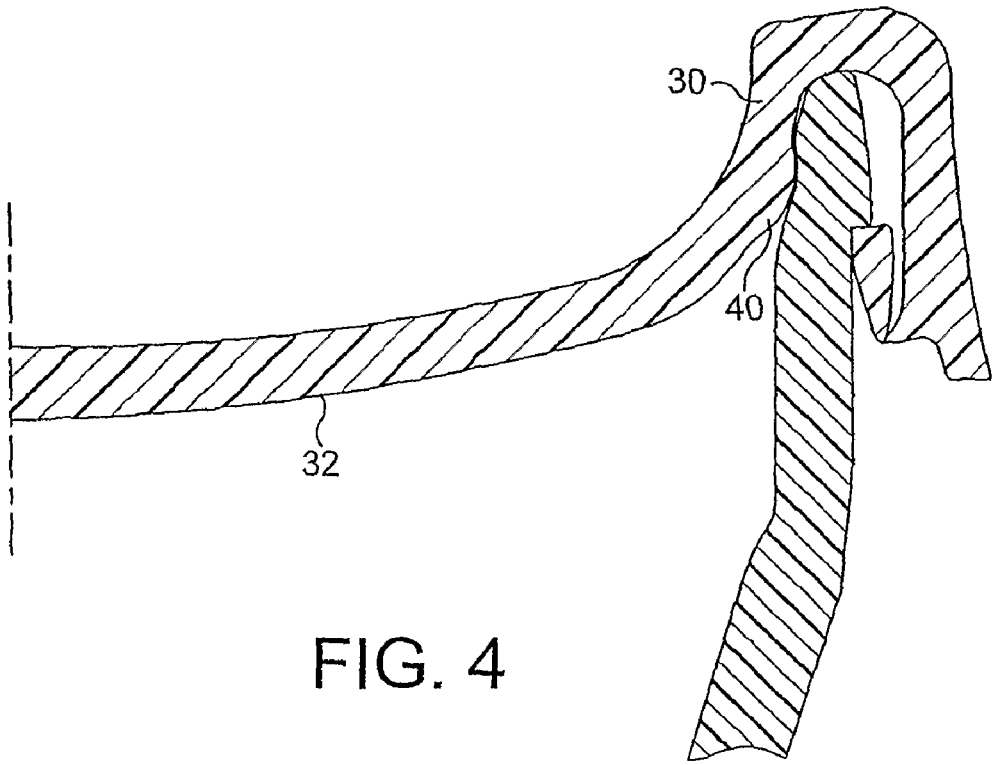
FIG. 4 is an enlarged sectional view of part of the upper portion of the bottle with a modified lid.

In the modified embodiment illustrated in FIG. 4, the outer surface of the wall portion 30 carries an annular protuberance 40, which engages the surface of a recess in the internal surface of the rim. If the gas pressure within the bottle should increase to a level sufficient to deform the lid upwardly to an extent sufficient to break the first gas seal, as is illustrated, the contact pressure of the upper portion of the protuberance with the surface of the recess will be increased, thereby increasing the integrity of the further gas seal, and compensate for the loss of the first gas seal. The protuberance could also be carried by the inner surface of the rim, in which case the recess will be formed in the wall portion 30. If the gas pressure in the container should increase substantially, it will be the contact pressure of the lower portion of the protuberance which will increase.

Figure 5:
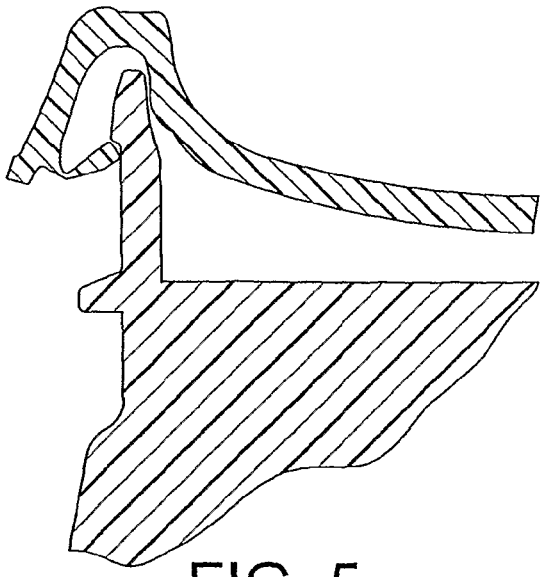
FIG. 5 is a view similar to FIG. 4 showing the lid becoming dislodged by an excessive gas pressure within the bottle.

Although the container described in the prior application is extremely effective and products a reliable gas seal, it is believed that failure may still be possible if the container is heated to an excessive temperature, e.g. as a result of being left in the sunshine, particularly if the beverage within it is carbonated. In this event, the gas pressure in the headspace of the container may rise to such a high level that the closure plate may be deformed upwardly by a significant distance. This deformation could result in significant deformation of the depending skirt resulting in its moving a significant distance away from the neck of the container. The resilience of the integral hinge will then cause the annular sealing flange to rotate with respect to both the depending skirt and the container until the position illustrated in the scrap diagrammatic view of one half of the top portion of the container shown in FIG. 5 is reached. Any further movement beyond that point will result in the sealing flange being impulsively rotated downwardly by the substantial gas pressure acting on its upper surface and thus in explosive depressurisation of the container, possibly associated with projection of the lid into the air by the gas pressure. Quite apart from the risk of injury to passers-by, the contents of the container will be rendered unusable and very possibly forcibly expelled from the container.

Figure 6:
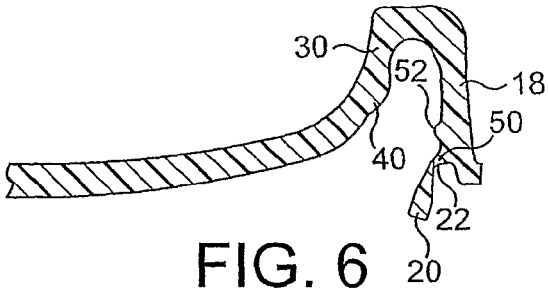
Figure 7:
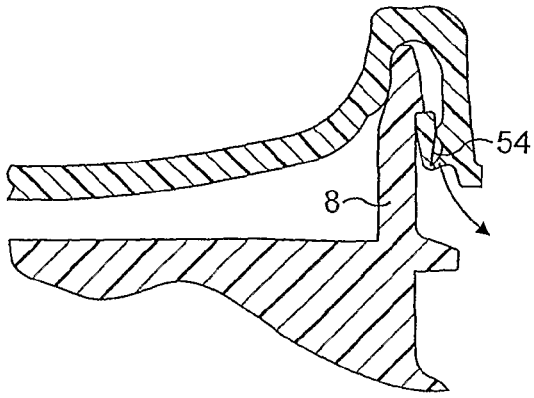

A potential situation to this problem is proposed in WO 2006/114558 and thus will now be explained with reference to FIGS. 6 and 7 in which:

FIG. 6 is a diagrammatic view similar to FIG. 4 of one half of the lid of the container; and FIG. 7 is a similar diagrammatic view of one half of the lid, when applied to the container.

The container and lid shown in FIGS. 6 and 7 are substantially the same as those described with reference to FIGS. 1 to 5 and the description will therefore not be repeated. However, there are three major differences.

Firstly, the integral hinge 22 has a small hole or aperture 50 formed in it adjacent the rip tab 24. The aperture 50 is of generally teardrop shape in this case, though it may also be triangular, and is partially defined by two surfaces which are convergent and meet at a point or acute angle immediately adjacent the connection of the rip tab and integral hinge. Secondly, an annular ridge or protuberance 52 is integrally formed on the inner surface of the depending skirt 18. When the lid is snap-fitted to the container it is rotated upwardly through nearly 180° into the configuration shown in FIG. 9. The protuberance 52 is forced into contact with the outer surface of the sealing flange 20 and forms a seal with it. The force applied by the protuberance to the sealing flange also results in an increase in the contact pressure of the inner surface of the sealing flange against the outer surface of the neck 8 and the seal of the container is therefore enhanced in two separate areas simultaneously. Furthermore, an annular chamber 54 is defined by the protuberance 52, the sealing flange 20, the integral hinge 20 and the depending skirt 18. This chamber communicates with atmosphere through the hole 50 but is normally sealed from the interior of the container. If, however, the pressure within the container should rise to an exceptionally high level, the lid is deformed by the pressure and the seals at the top surface and internal surface of the neck of the container are broken. The skirt 18 is also deformed outwardly and the seal between the protuberance 52 and the sealing flange 20 is thus broken also. The interior of the container therefore communicates with atmosphere through the hole 50 and is thus vented. The pressure then drops until it has reached a level at which the resilience of the lid is sufficient to restore its shape against the reduced pressure of the gas within the container. The various seals are then recreated and venting of the interior of the container is terminated with the container gas pressure still at a significant level. The contents of the container are thus maintained in the container and are still usable. The gas venting opening may become blocked by dust or the like and thus become unable to perform its venting function and it is therefore desirable for one or more further gas venting openings also to be provided which communicate with the chamber 54 and pass through the hinge 22 or the skirt 18.

If it is desired to open the container, that is to say to remove the lid, a lateral force is applied to the rip tab 24 in the direction away from the opening 50. The opening 50 acts as a point of weakness and its converging edges act as a stress concentrator and the integral hinge 20 thus begins to tear in the circumferential direction. The container is thus vented to atmosphere. Continued application of the force results in the tearing continuing and once abut one half of the integral hinge has torn, the cap will come free from the top of the bottle and its contents may then be drunk or dispensed into a glass.

However, even this modification may not be sufficient under all circumstances to enable the lid to satisfactorily retain the pressure in the container and under some circumstances an even greater sealing integrity may be desirable.

The lid may be made of a variety of materials but one particularly appropriate material is polypropylene because it is cheap, durable and easily moulded. It does however, not tear very easily and difficulties can be encountered in opening the bottle by pulling on the rip tab because it is not always possible to induce the lid to tear along the desired line.

It is therefore an object of the invention to provide a beverage container, particularly of wide mouthed type, with a reliably sealed lid which can contain the pressure normally generated by a carbonate beverage, even under relatively high ambient temperature conditions, but which, if an exceptionally high internal pressure should be generated, will vent the interior of the container to a lower pressure which can readily be contained, without loss of the lid or the container contents and without permitting the pressure to drop to atmospheric. A further object of the invention is to modify the lid so that it may be simply and reliably opened.

According to the present invention a beverage container is provided with features set forth in claim 1.

Thus the container in accordance with the present invention is substantially the same as that described with reference to FIGS. 6 and 7 but differs from it in one important feature. Thus the said one side surface of the annular flange includes an annular portion which extends downwardly and inwardly and is in contact with a corresponding annular portion of the surface of the annular protuberance. The side surface of the annular flange directed towards the neck of the container has a portion which is directed downwardly to an extent and contacts similarly downwardly directed portions of the opposing surface of the protuberance. This means that an increased pressure in the container will result in an increase contact pressure between the inclined surfaces and thus in an increase in the sealing integrity. Furthermore, a proportion of any increased tensional stress in the depending skirt will be transferred to the flange and thence to the neck of the container by virtue of the engagement of the flange with the underside of the shoulder on the neck of the container. Thus only a proportion of any increased tensional stress is applied to the integral hinge and this may therefore be thinner than would otherwise be the case. This facilitates rupturing or tearing of the integral hinge for the purpose of removing the lid.

In the preferred embodiment, the said one surface of the annular flange includes an annular portion which extends downwardly and inwardly and is in contact with a corresponding annular portion of the surface of the annular protuberance.

It is preferred that the gas passage comprises one or more holes formed in the integral hinge. It is also preferred that the container includes a rip tab integrally connected to the integral hinge adjacent one of the said holes. Since the rip tab is connected to the hinge at a position adjacent the aperture in the hinge, if a lateral force is applied to the rip tab in the direction away from the aperture, then the aperture will act as a stress concentrator and tearing of the integral hinge will commence. This is facilitated by the fact that the integral hinge will in any event be relatively flimsy so as to have the necessary resilience. Once tearing has commenced, only a relatively small force is needed to keep it going. Once the tear has gone about half way round the hinge, the lid may be very simply removed from the container. The aperture in the hinge thus serves two quite separate functions.

In an alternative embodiment, the rip tab is replaced by a cutter ring which is retained captive on the lid and is rotatable with respect to the lid, the cutter ring including a cutter blade which extends through the hole, whereby rotation of the cutter ring results in the cutter blade cutting the integral hinge and thus releasing the lid from the container. Thus in this embodiment, the integral hinge is not ruptured by tearing initiated by a rip tab but is instead cut by one or more cutter blades. The or each cutter blade extends through a respective hole in the integral hinge and when the cutter ring is rotated, the or each blade will contact the adjacent edge of the hole in the integral hinge and cut the hinge until the cap comes free from the container. When it does so, the annular flange will of course be left in position extending around the neck of the container.

Whilst there may be only a single hole and associated cutter blade, it is preferred there are two or more holes, preferably four holes, formed in the integral hinge substantially equiangularly spaced and that the cutter ring includes a respective cutter blade extending through each hole.

In the preferred embodiment the cutter ring has inwardly extending flange at its upper end which extends above the skirt of the lid and an inwardly extending flange at its lower end which extends below the skirt of the lid, whereby the cutter ring is captive on the lid and can move with respect to it only in rotation. The lower inwardly extending flange preferably carries the or each cutting blade.

Figure 8:
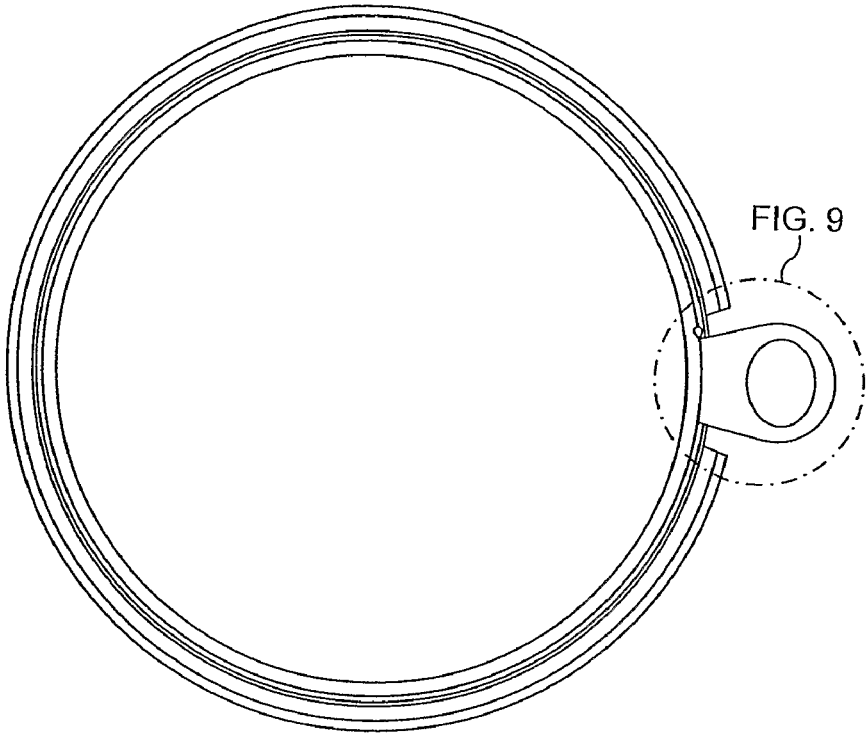
Figure 9:
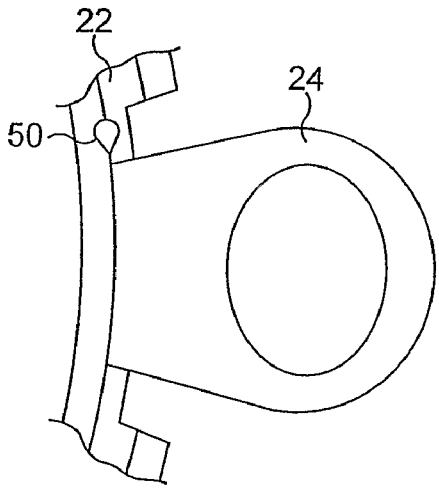
Figure 10:
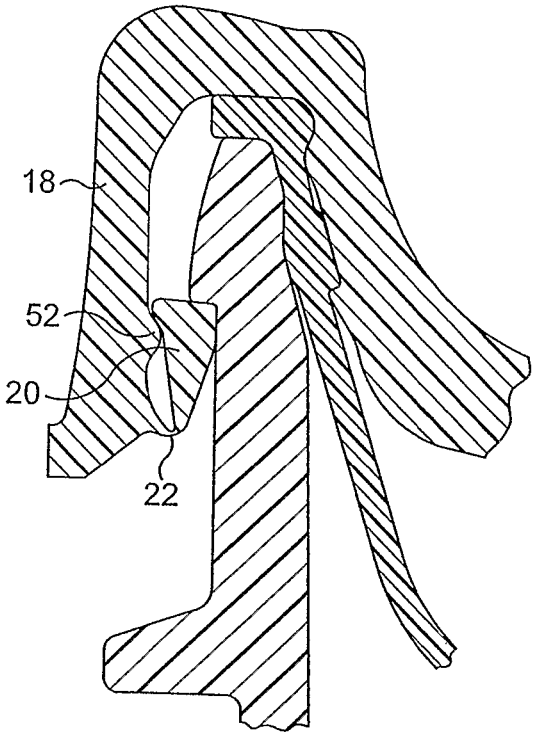
Figure 11:
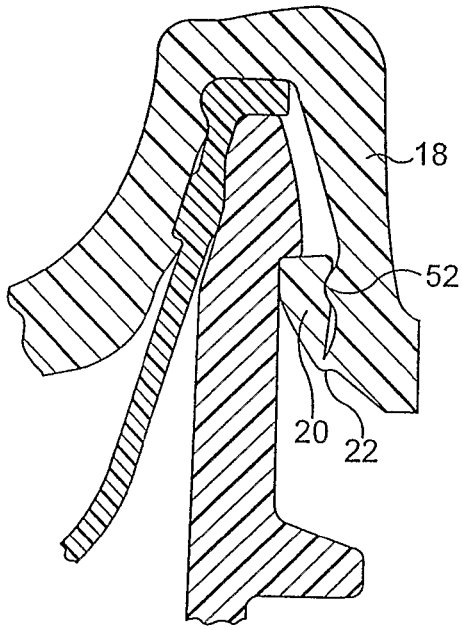
Figure 12:
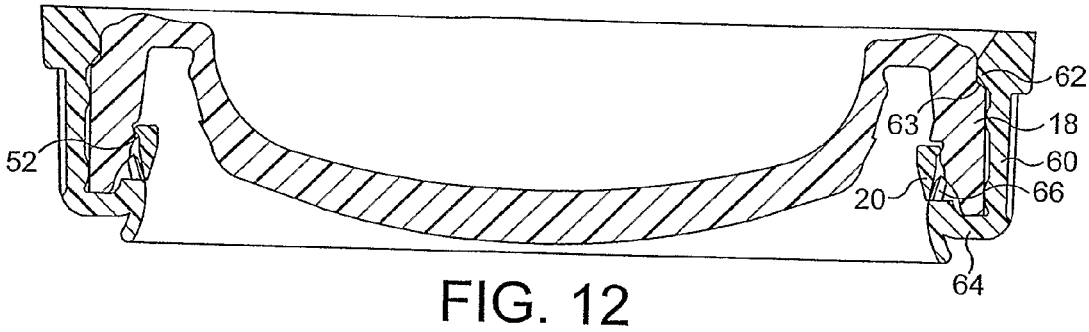
Figure 13:
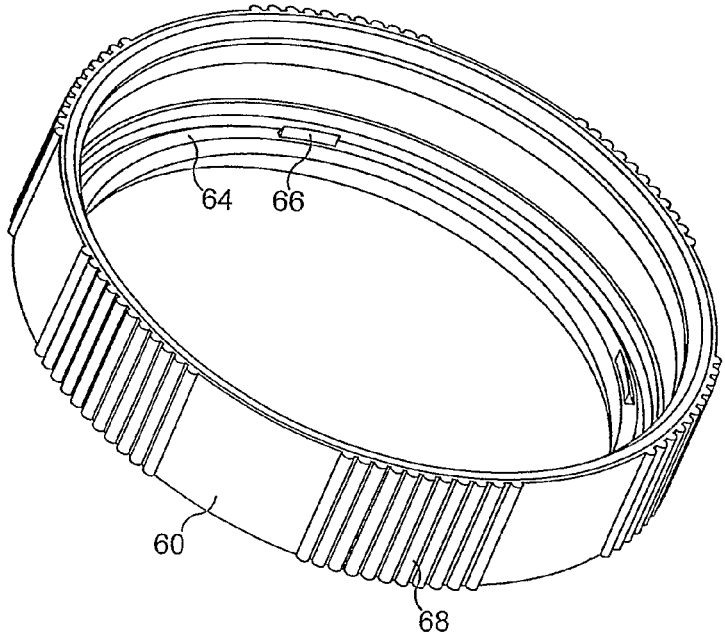

Further details of the invention will be apparent from the following description of two specific embodiments, which is given by way of example only with reference to FIGS. 8 to 13 of the accompanying drawings, in which:

FIG. 8 is an underneath view of one embodiment of lid for a container in accordance with the present invention;

FIG. 9 is a view on an enlarged scale of the rip tab shown in FIG. 8;

FIGS. 10 and 11 are view similar to FIG. 4 of the lid shown in FIGS. 8 and 9;

FIG. 12 is a cross-sectional view of a second embodiment of lid for a container in accordance with the invention; and FIG. 13 is a perspective view from below of the cutter ring of the lid shown in FIG. 12.

The container and lid in accordance with the present invention are substantially the same as those described above and the description will therefore not be repeated. There are, however, a number of differences.

Referring firstly to FIGS. 8 to 11, the integral hinge 22 has a small hole or aperture formed in it adjacent the rip tab 24. The aperture 50 is of generally tear drop shape in this case, though it may also be triangular, and is partially defined by two surfaces which are convergent and meet at a point or acute angle immediately adjacent the connection of the rip tab and integral hinge. If it is desired to open the container, that is to say to remove the lid, a lateral force is applied to the rip tab 24 in the direction away from the opening 50. The opening 50 acts as a point of weakness and its converging edges act as stress concentrator and the integral hinge thus begins to tear in the circumferential direction. The container is thus vented to atmosphere. Continued application of the force results in the tearing continuing and once about one half of the integral hinge is torn, the cap will come free from the top of the bottle and its contents may then be drunk or dispensed into a glass or the like.

As shown in FIGS. 10 and 11, the protuberance 52 is of rounded triangular section, which means that the upper half of its inwardly directed surface extends downwardly and inwardly. This portion of its surface engages a corresponding inclined portion of the surface of the flange 20. The embodiment of FIG. 13 is substantially the same but in this case the protuberance 52 is at least partly received in a correspondingly shaped recess in the opposing surface of the flange 20. In both cases, if the pressure within the container should increase, the contact pressure between the two inclined surfaces, that is to say the downwardly and inwardly inclined surface on the skirt and the upwardly and outwardly inclined surface on the flange 20, is increased, whereby the sealing integrity is significantly increased. A significantly larger pressure within the container is therefore necessary to dislodge the cap by comparison with the known container lid. Furthermore, when the pressure within the container increases, a proportion of the increased tensional stress in the skirt 18 is transmitted via the pair of inclined engaging surfaces to the flange 20 and then to the neck of the container via the engagement of the flange 20 with the underside of the shoulder. It is therefore not applied to the integral hinge 22, which may thus be of very thin and light construction which may be readily torn when a lateral force is applied to the rip tab. FIGS. 10 and 11 show a further component situated between the neck of the container and the lid but this forms no part of the present invention and will therefore not be described.

The embodiment of FIGS. 12 and 13 differs from that described above in that the rip tab is replaced by a cutter ring. As may be seen in FIG. 12, the depending skirt 18 is surrounded by a cylindrical member 60, which constitutes a cutter ring. This is retained captive on the skirt by virtue of a shoulder 62, which affords a downwardly directed surface opposed to an upwardly directed surface 63 of the skirt, thereby preventing movement of the cutter ring 60 with respect to the skirt in the downward direction, and a lower flange 64, which extends beneath the skirt 18 and thus prevents upward movement of the cutter ring 60 with respect to the skirt. Formed in the integral hinge 22 are four elongate holes (not shown), which are mutually offset from one another by 90°. Upstanding from the flange 64 are four cutter blades 66, which are again mutually offset by 90°. Each cutter blade constitutes a web which extends in the circumferential direction and whose end is of generally V-shape. The V-shaped ends may both be of tapered shape in a manner similar to a knife blade, though this is found in practice not to be essential. Each cutter blade 66 is received within a respective hole in the integral hinge 22.

The cutter ring 60 is not only captive on the lid but is also restrained from movement with respect to the lid other than in rotation. If it is desired to open the container, the cutter ring is rotated in either direction. To facilitate such rotation by the user, the cutter ring is provided with a knurled surface or, as in this case, a number of spaced knurled portions 68. Rotation of the cutter ring 60 will result in one or other of the blade-like end portions of the cutters 66 coming into contact with the adjacent edge of the holes in which they are received. This contact will initiate cutting of the integral hinge and continued rotation of the cutter ring 60 will result in complete cutting of the integral hinge, whereby the lid and cutter ring will then come free from the container. Due to the fact that four cutting blades 66 are provided, rotation of the cutter ring through 90° is sufficient to completely release the lid. As a result of the fact that the cutters 66 have blades at both ends, rotation of the cutter ring 60 in either direction will result in cutting of the integral hinge and thus removal of the lid.

The invention claimed is:

1. A beverage container comprising a receptacle which has a central axis and is sealed by a lid of resilient material, the receptacle including a neck defining an opening and the lid including a closure plate, integral with which is a depending skirt extending around the outer surface of the neck, the skirt carrying an annular flange, which is in sealing engagement with the underside of a downwardly directed annular shoulder on the outer surface of the neck, wherein the annular flange is connected to the skirt by a hinge connection, the annular flange is elongate in axial sectional view, the end surface of the free end of the annular flange is in sealing engagement with the underside of the shoulder, and the internal surface of the skirt carries an annular protuberance which is in sealing engagement with one side surface of the annular flange, the other side surface being in sealing engagement with the outer surface of the neck, whereby an annular chamber is defined by the inner surface of the skirt, the said one side surface of the annular flange, the protuberance and the hinge, a gas passage being provided which extends between the annular chamber and atmosphere, characterised in that the said one side surface of the annular flange includes an annular portion which extends downwardly and inwardly and is in contact with a corresponding annular portion of the surface of the annular protuberance.

2. A container as claimed in claim 1 in which the said one side surface of the annular flange has an annular recess formed in it, into which the said annular protuberance at least partly fits.

3. A container as claimed in claim 1 in which the gas passage comprises at least one hole formed in the integral hinge.

4. A container as claimed in claim 3 including a rip tab integrally connected to the integral hinge adjacent one of said at least one hole.

5. A container as claimed in claim 1 including a cutter ring which is retained captive on the lid and is rotatable with respect to the lid, the cutter ring including a cutter blade which extends through the hole, whereby rotation of the cutter ring results in the cutter blade cutting the integral hinge and thus releasing the lid from the container.

6. A container as claimed in claim 5 in which there are two or more holes formed in the integral hinge substantially equiangularly spaced and the cutter ring includes a respective cutter blade extending through each hole.

7. A container as claimed in claim 5 in which the cutter ring has a downwardly directed surface at its upper end, which extends above an upwardly directed surface on the lid and an inwardly extending flange at its lower end, which extends below the skirt of the lid and carries the or each cutting blade.

* * * * *